US005744239A

United States Patent [19]

Buccellato et al.

[11] Patent Number: 5,744,239

[45] Date of Patent: Apr. 28, 1998

[54] ADDITION OF ANTIMICROBIAL AGENTS TO PAVEMENT MARKING MATERIALS

[75] Inventors: Gina M. Buccellato, Eagan; Rochelle R. Robideau, St. Paul; Keith M. Hoffmann, North St. Paul; Gregory F. Jacobs, Woodbury, all of Minn.

[73] Assignee: Minnesota Mining and Manufacturing Company, St. Paul, Minn.

[21] Appl. No.: 723,209

[22] Filed: Sep. 27, 1996

[51] Int. Cl.[6] ..... B32B 9/04

[52] U.S. Cl. ..... 428/411.1; 428/195; 428/343; 428/355 R; 428/488.4; 428/688; 427/136; 427/207.1

[58] Field of Search ..... 428/195, 411.1, 428/913, 914, 488.4, 688, 355 R, 343; 156/212; 427/136, 207.1

[56] References Cited

U.S. PATENT DOCUMENTS

| | | | |
|---|---|---|---|
| Re. 28,531 | 8/1975 | de Vries | 260/22 CB |
| Re. 30,463 | 12/1980 | Miller et al. | 260/22 CQ |
| 3,451,537 | 6/1969 | Freeman et al. | 206/59 |
| 3,891,451 | 6/1975 | Okazaki et al. | 106/30 |
| 3,902,939 | 9/1975 | Eigenmann | 156/71 |
| 3,998,645 | 12/1976 | Okazaki et al. | 106/30 |
| 4,025,476 | 5/1977 | Miller et al. | 260/22 |
| 4,310,509 | 1/1982 | Berglund et al. | 428/28 |
| 4,324,711 | 4/1982 | Tanaka et al. | 523/172 |
| 4,388,359 | 6/1983 | Ethen et al. | 428/143 |
| 4,490,432 | 12/1984 | Jordan | 428/220 |
| 4,681,401 | 7/1987 | Wyckoff | 350/105 |
| 4,766,113 | 8/1988 | West et al. | 514/187 |
| 4,906,523 | 3/1990 | Bilkadi et al. | 428/327 |
| 5,077,117 | 12/1991 | Harper et al. | 428/143 |
| 5,167,705 | 12/1992 | Coughlan | 106/36 |
| 5,194,113 | 3/1993 | Lasch et al. | 156/243 |
| 5,194,541 | 3/1993 | Legros et al. | 526/245 |
| 5,227,221 | 7/1993 | Hedblom | 428/172 |
| 5,238,749 | 8/1993 | Cueman et al. | 428/441 |
| 5,258,425 | 11/1993 | Kirby | 523/337 |
| 5,305,827 | 4/1994 | Steele et al. | 165/133 |
| 5,310,278 | 5/1994 | Kaczmarczik | 404/14 |
| 5,340,870 | 8/1994 | Clinnin et al. | 524/522 |
| 5,352,279 | 10/1994 | Fusi et al. | 106/19 B |
| 5,453,320 | 9/1995 | Harper et al. | 428/356 |
| 5,468,795 | 11/1995 | Guder | 524/361 |
| 5,536,768 | 7/1996 | Kantner et al. | 524/376 |

FOREIGN PATENT DOCUMENTS

| | | |
|---|---|---|
| 0 422 532 A2 | 4/1991 | European Pat. Off. . |
| 0 764 699 A2 | 3/1997 | European Pat. Off. . |
| 2087653 | 12/1971 | France . |
| 28 46 088 A1 | 4/1980 | Germany . |
| 1 129 921 | 10/1968 | United Kingdom . |
| 1154504 | 6/1969 | United Kingdom . |
| 1 398 282 | 6/1975 | United Kingdom . |
| WO 93/15152 | 8/1993 | WIPO . |

OTHER PUBLICATIONS

"ANGUS Chemical Company Technical Sheet—AMICAL", IDS 36, pp. 1–8 (1992).

"BIOCIDES", Brochure of Olin Chemical, pp. 2–6 (1994).

"DOWICIDE A Antimicrobial: Excellent aqueous and polar organic solvent solubility for preservative applications", Brochure of Dow Chemical Co., pp. 2–6 (Undated).

P. Dunn et al., "Antifungal sealing rings: a new approach", *Plastics and Rubber: Materials and Applications*, 3, pp. 87–96 (Aug. 1978).

"Material Safety Data Sheet—AMICAL 48", ANGUS Chemical Company, pp. 1–2 (Aug. 16, 1989).

"Material Safety Data Sheet—Metasol TK-100 Powder", Calgon Corporation, pp. 1–5 (Jun. 11, 1992).

"Pavement Surface Preparation and Application Procedures for 3M Scotch-Lane Tapes, Information Folder 3.2", Brochure of 3M, pp. 1–5 (Jun. 1995).

"Pavement Surface Preparation and Application Techniques for 3M Stamark Tapes, Information Folder 5.7", Brochure of 3M, pp. 1–10 (Aug. 1994).

"Recommended Applications for 3M Stamark Pavement Marking Tapes, Information Folder 5.9", Brochure of 3M, pp. 1–5 (Jun. 1996).

"Rhoplex Fastrack 2706: Polymer Emulations for Waterborne Marking Paints", Brochure of Rohm and Haas Company, pp. 1–22 (1994).

R.T. Ross, "Biodeterioration of Paint and Paint Films", *Journal of Paint Technology*, 41, pp. 266–274 (Apr. 1969).

"METASOL TK-100", Brochure of Calgon Corporation, Bulletin No. 30-14c, pp. 1–4 (1989).

"Zinc Omadine Bactericide-Fungicide", Brochure of Olin Chemicals, pp. 1 (1995).

*Primary Examiner*—William Krynski

*Attorney, Agent, or Firm*—Robert H. Jordan

[57] ABSTRACT

This invention relates to the addition of antimicrobial agents to pavement marking systems to inhibit the growth of microorganisms on and under the pavement marking when it is affixed to a pavement.

33 Claims, No Drawings

ADDITION OF ANTIMICROBIAL AGENTS TO PAVEMENT MARKING MATERIALS

FIELD OF THE INVENTION

This invention relates to the use of antimicrobial agents in preformed pavement markings to control growth of the microorganisms when the pavement markings are in place on a pavement.

BACKGROUND OF THE INVENTION

Preformed pavement marking materials are used as traffic control markings for a variety of uses, such as short distance lane striping, stop bars, and pedestrian lane markings at cross walks as well as lane and shoulder delineators or as skips on highways. Typically, preformed pavement marking materials comprise a continuous, preferably wear-resistant top layer overlying a flexible base sheet. Such marking materials are typically applied to pavement surfaces using pressure-sensitive adhesives and/or contact cement.

The marking material itself can include one or more layers such as the pavement marking materials disclosed in U.S. Pat. No. 5,453,320 to Harper et al. and U.S. Pat. No. 5,227,221 to Hedblom. The pavement marking material optionally includes exposed reflective elements and/or skid resisting particles such as those described in U.S. Pat. No. 5,194,113 to Lasch et al. and U.S. Pat. No. 5,310,278 to Kaczmarczik et at. Other pavement marking materials are disclosed in U.S. Pat. Nos. 3,782,843, 3,935,365, 3,399,607, 4,020,211, 4,117,192, 4,990,024, 4,490,432, 4,069,281, and 4,146,635.

Pavement markings generally also include primer and adhesive coats. The markings are typically applied using one or more primer coats that are first positioned onto a pavement. Primer coat compositions for pavement markings are known in the art. These include, for example, U.S. Pat. No. 4,906,523 to Bilkadi et al., U.S. Pat. No. 5,468,795 to Guder et at. An adhesive is applied to the marking material and the marking material is positioned on the primer. Adhesives are known in the art and these include, for example, U.S. Pat. Nos. 3,902,939 and 5,453,320.

Pavement markings are applied to pavements in a variety of geographical locales that vary from one another in their temperatures, the length of their seasons and in the amount and type of moisture that the geographical areas receive. Pavement markings are subject to extreme temperatures, to extreme shear forces from vehicles starting, accelerating, decelerating, turning and stopping (i.e., traffic stress) on the markings and to direct assault from rain, sleet, snow, hail, and the like. Moreover, pavement markings are subject to wear from dirt and debris present in water on the pavements and delivered to the pavement from the vehicles or as surface or storm water runoff. The pavement markings, the adhesives and the primers are expected to remain intact and attached to the pavement surface despite these adversities.

These adverse conditions can compromise the integrity of the pavement marking. The adhesive properties of the marking can be reduced under some environmental conditions and the integrity of the top marking layer can be disturbed resulting in reduced skid resistance or reduced reflective properties. For example, it has been observed that pavement markings can have a reduced life-span in certain geographical areas, including those areas receiving heavy rainfall. Water in small pockets between the marking and the pavement surface can act to hydraulically lift the marking from the pavement surface, especially when the pavement marking is exposed to heavy traffic or to temperature swings including cycles of freezing and thawing. There is a need for methods and compositions that result in increased longevity of the pavement markings in areas where adverse conditions compromise the integrity of the marking product on the pavement.

Some antimicrobial agents have been used in paints as in-can preservatives and some antimicrobial agents have been used to prevent discoloration, the loss of decorative properties, and the like, in house paint (see Ross, *Journal of Paint Technology* 41(5): 266–274, 1969). Antimicrobial agents have been disclosed for use in products containing wood-derived materials as an in-can preservative and to preserve the aesthetics of the wood-based product. Antimicrobials for adhesives for indoor floor coverings for use in hospitals and operating rooms are disclosed in U.S. Pat. No. 5,258,425. None of these publications suggest the addition and use of antimicrobial agents to improve the longevity of a pavement marking on a pavement.

SUMMARY OF THE INVENTION

The present invention resulted from the discovery that microbial growth on or under the pavement markings when the markings are positioned on the pavement can compromise the integrity of the marking. Vehicle and weather wear on the pavement marking combined with microbial deposits from surface or storm water runoff, vehicles and pedestrian and/or animal traffic can result in focal or disseminated microbial growth in the pavement marking materials. Microbial growth erodes the pavement marking material, reducing its adhesive properties as well as destroying its integrity on the pavement surface. Microbial growth also exacerbates the lift effect of small pockets of water that become trapped between the marking and the pavement.

This invention includes the addition of one or more antimicrobial agents to one or more components of a pavement system where the pavement system includes a pavement marking together with the primers and/or adhesives used to affix one or more layers of the pavement marking together and/or are used to adhere and affix the pavement marking to a pavement.

In one aspect of this invention a pavement marking system is disclosed that comprises a preformed pavement marking comprising at least one layer and a pavement contacting surface; and an adhesive composition comprising an antimicrobial agent applied to the pavement contacting surface of the pavement marking. The antimicrobial agent can have a variety of solubilities in water and in one embodiment the solubility in water of less than 0.002 g/L at 25° C. In one embodiment of this aspect of the invention the pavement marking system includes an antimicrobial agent in at least one layer of the marking. In another embodiment the pavement marking system additionally comprises a primer. The primer can comprise an antimicrobial agent. Preferably the antimicrobial agent in the pavement marking system is capable of inhibiting more than one species of microorganism at concentrations of antimicrobial agent of less than about 1000 ppm on nutrient salts agar. Preferably the antimicrobial agent is capable of inhibiting more than one species of fungus and/or more than one species of bacteria.

In another aspect of this invention a pavement marking system is disclosed where the pavement marking system comprises a preformed pavement marking comprising at least one layer, the marking having a pavement contacting surface; an adhesive applied to the pavement contacting surface of the preformed pavement marking; a liquid primer; and at least one antimicrobial agent contained within the system such that the antimicrobial agent is present in the pavement marking system when the system is affixed to a pavement. In one embodiment the antimicrobial agent is contained within at least one layer of the preformed pavement marking. In another the antimicrobial agent is contained within the primer and in another embodiment the antimicrobial agent is contained within the adhesive. Preferably the antimicrobial agent has a solubility in water of less than 0.002 g/L at 25° C. and preferably the antimicrobial agent contained within the system is capable of inhibiting more than one species of microorganism at a concentration of less than about 1000 ppm. In one aspect of this embodiment the microorganism is a species of fungi and/or a species of bacteria.

Another aspect of this invention relates to a preformed pavement marking comprising one or more layers wherein one or more layers of the marking comprise at least one antimicrobial agent wherein the antimicrobial agent is capable of inhibiting more than one species of microorganism at a concentration of less than about 1000 ppm in nutrient salts agar.

Yet another aspect of this invention relates to a pavement marking system comprising: a preformed pavement marking comprising one or more layers; an adhesive comprising an antimicrobial agent; and a primer comprising an antimicrobial agent. In one embodiment the preformed pavement marking comprises at least one antimicrobial agent.

This invention also relates to methods for applying pavement marking systems to a pavement. In one embodiment of a method for applying pavement marking systems to a pavement, the method comprises the steps of coating a pavement surface with a primer comprising at least one antimicrobial agent; and positioning and affixing a pavement marking, the pavement marking having a pavement contacting surface, onto the primer with the pavement contacting surface contacting the primer. Preferably the pavement marking of the positioning and affixing step comprises at least one layer wherein at least one of the layers includes an antimicrobial agent. In another embodiment the method additionally comprises the steps of applying an adhesive to the pavement contacting surface of the pavement marking and contacting the adhesive on the pavement contacting surface with the primer. Preferably the adhesive contains at least one antimicrobial agent. In a preferred aspect of this invention the method additionally comprises the step of cleaning the pavement prior to the coating step and preferably the cleaning step includes treating the pavement with at least one antimicrobial agent before the coating step. The method for applying a pavement marking system to a pavement can additionally comprise the step of treating the pavement marking system with at least one antimicrobial agent after the positioning and affixing step.

Another aspect of this invention relates to a method for making an adhesive coated pavement marking comprising the steps of adding an antimicrobial agent to an adhesive capable of adhering a preformed pavement marking to a pavement; and coating at least a pavement contacting surface of the preformed marking with the adhesive.

This invention also relates to a method for maintaining the integrity of a pavement marking system on a pavement comprising the steps of: treating the pavement marking system on the pavement at least once with an antimicrobial agent. Preferably the treating step is performed at least once a year.

The invention also relates to a method for increasing the life-span of a pavement marking system on a pavement comprising the steps of: including at least one antimicrobial agent in the pavement marking system where the antimicrobial agent applied to sterile nutrient salt agar is sufficient to inhibit the growth of at least one species of microorganism on a nutrient agar petri plate when the antimicrobial agent has been preincubated for at least three weeks at about 35° C.

DETAILED DESCRIPTION OF PREFERRED EMBODIMENTS

This invention discloses the addition of antimicrobial agents to preformed pavement marking systems. Components of the preformed pavement marking system include the pavement markings, primers and/or adhesives. Preformed pavement markings include tapes and individual markings. Both the tapes and markings include removable and permanent preformed pavement marking forms. The term "preformed" is used to refer to the pre-made character of the pavement marking as distinguished from, for example, liquid pavement markings. For purposes of this application the term "primer" is used herein to refer to adhesive compositions in a liquid state, including, but not limited to contact cements, and the like that are applied to a pavement, including a roadway, or to a pavement marking at the site of pavement marking system installation. An "adhesive" is used herein to refer to adhesive compositions that are applied to the pavement marking prior to the time of pavement marking system installation, and generally at the time of pavement marking manufacture. The addition of antimicrobial agents to pavement markings helps to maintain the integrity of the pavement markings on the pavement surface.

It has been observed that pavement markings can be compromised by microbial growth in, around and beneath a pavement marking. Fungal filaments as well as algae and bacterial colonies have been observed on both the top of the pavement marking surface and beneath the surface of the pavement marking on the pavement. These observations have been made in various geographic locales, particularly in moist climates such as those exposed to significant amounts of rainfall and/or humidity. All layers of a preformed pavement marking portion of a pavement marking system can be subjected to microbial degradation and microscopic analysis has confirmed the presence of bacteria and fungal growth in all layers of the preformed marking. The under surfaces of the marking also appeared to support the growth of a variety of microorganisms. Microorganism growth resulted in the degradation of the top surfaces of the pavement marking and compromised the adhesive capacity of the marking resulting in general pavement marking deterioration.

Studies were conducted in the laboratory to further explore the ability of microbes to grow on the components of the preformed pavement markings. Activated sludge from water treatment plants was applied to free primer films produced by coating primer onto a silicone release liner support, allowing the primer coat to dry, and removing the liner to produce a free primer film. The term "activated sludge" is used here in to refer to a microbiological enrichment culture consisting of a mixed and largely uncontrolled consortium of micro and macroorganisms. The sludge was obtained from the aerobic treatment of sewage samples obtained from waste water treatment plants. This fraction is also known in the art as a "mixed liquor" sample. A significant change in tensile strength of the primer was observed following an incubating period permitting microbial growth on the film (see Example 1). The results indicated that microbial attack of the primer results in compromised primer performance.

Microbial growth also compromised the integrity of the pavement marking layers. In the field, microorganisms (including bacterial colonies, fungus and algae) were identified in all layers of the pavement marking based on visual inspection and microscopic analysis. The pavement marking appeared to take on a swelled, sponge-like texture and top portions of the pavement marking could be pulled away from the pavement surface in a "gum-like" fashion. Samples of the pavement marking having these characteristics were placed on petri plates containing nutrient agar and the characteristics observed in the field were exacerbated with further incubation under conditions known to support microorganism growth (see Example 2).

Any of a variety of components of the pavement marking can be susceptible to degradation by one or more microorganisms. For example, microorganisms can be sequestered in the piers and adhesives used to affix the pavement marking. The addition of an antimicrobial agent by the manufacturer of the primer or the adhesive will limit microorganism growth on the pavement. Alternatively, the antimicrobial agent can be added to the primer prior to the application of the pavement marking onto the pavement, including at the site of palmer manufacture and/or the antimicrobial agent can be added to the adhesive at the site of manufacture or as a spray coat at the time of pavement installation. Antimicrobial agents can also be added to the pavement marking during manufacture or prior to use. The addition of antimicrobial agents to pavement marking systems can limit the growth of a wide range of microorganisms including a variety of strains of bacteria, fungus, including molds and mildew, as well as algae. Alternatively antimicrobial agents can be applied directly onto a pavement with the pavement marking positioned over the antimicrobial agent to integrate the antimicrobial agent into the pavement marking system.

The antimicrobial agents useful for this purpose are those that are able to exhibit antimicrobial activity for extended periods of time and at elevated temperatures. Antimicrobial agents suitable for use in pavement marking systems are those that preferably are able to exhibit antimicrobial activity in at least one component of a pavement marking system after being exposed to temperatures of at least 35/C. for a period of preferably at least about three weeks. In addition, the antimicrobial agents preferably exhibit antimicrobial activity over a range of pH's including pH ranges from less than about pH 4.5 to greater than about pH 9.0. The antimicrobial agent should remain active in rain water, for example, which generally has a pH of about 5.0.

The antimicrobial agent or combination of antimicrobial agents are preferably considered to be ecologically safe, i.e. meets or can meet the Environmental Protection Agency (EPA) standards for minimum toxicity at the concentrations present in run-of from pavement markings containing the antimicrobial agent. For example, the antimicrobial agent preferably does not include certain metals, including tin or heavy metals, including, but not limited to mercury, arsenic, cadmium, lead, copper, chromium and the like, in proportions exceeding those recommended by the EPA. In one embodiment, the antimicrobial agents do not readily leach from the pavement marking material in the presence of water; that is, the antimicrobial agent preferably has a low solubility in water. Preferably the antimicrobial agent has a solubility in water of less than 0.01 g/L and more preferably a solubility in water of less than 0.002 g/L at 25° C. In another embodiment, the antimicrobial agent is soluble in water.

One way to assess the effect of antimicrobial agent solubility on the efficacy of the antimicrobial agent as an inhibitor of microorganism growth in a pavement marking system is to expose one or more components of the pavement marking system that contain the antimicrobial agent to water at a pH approximating rainwater and then test the ability of the antimicrobial agent to inhibit microorganism growth. One method for assessing the effect of antimicrobial agent solubility on inhibitory capacity of the antimicrobial agent is to modify the Toxicity Characteristic Leaching Procedure and Bactericide-Fungicide Performance test provided in 40 CFR chapter 1, Appendix II of Part 261—Method 1311. Similar tests are provided in methods entitled "Test Methods for Evaluating Solid Waste, Physical/Chemical Methods" provided in EPA Publication SW-846. To determine whether or not a particular antimicrobial agent will function in a pavement marking system after rain exposure, samples of pier, samples of marking, samples of adhesives or combinations thereof are prepared with and without antimicrobial agent and are allowed to air-dry for 48 hours. Primer films can be prepared using the methods provided in Example 3 using silicone-lined paper. Samples including, but not limited to, primer films, markings with adhesive, markings alone, and the like are placed after drying into an extraction vessel (typically borosilicate glass containers with non-reactive caps) and exposed to water at a pH of about 5.0. For example, water mimicking the pH of rainwater can be prepared by adding 5.7 mL glacial $CH_3CH_2OOH$ to 500 mL of Millipore Milli-Q™ water, with 64.3 mL of 1N NaOH added and the total volume diluted to one liter.

The extraction vessel is filled with fluid at a ratio of20:1 extraction fluid: solid sample volume and placed on, for example, an agitating apparatus (for example an agitation apparatus with end-over-end rotation at about 30 rpm at about 23°–25° C. for a period of about 16–20 hours). After the extraction period the extraction fluid is filtered through a glass fiber filter with a pore size of about 0.6 to about 0.8 μm. The solid sample is allowed to air-dry for preferably at least 24 hours. The solid sample is placed on nutrient-salts agar (see examples) and tested using the methods of Example 3 for its ability to inhibit microorganism growth following the leaching process. The liquid portion is split for analysis of organic and inorganic analysis following the methods outlined in the Toxicity Characteristic Leaching Procedure and Bactericide-Fungicide Performance Test Code of Federal Regulations publication.

The antimicrobial agents or the resulting antimicrobial activity of a combination of one or more different antimicrobial agents preferably have, in total, broad spectrum antimicrobial activity, meaning that the antimicrobial agent or the combination of antimicrobial agents should be capable of inhibiting more than one species of fungi and preferably more than one species of bacteria at an antimicrobial concentration of less than about 1500 ppm and preferably less than about 1000 ppm in standard nutrient salts media.

Some of the antimicrobial agents having the characteristics that permit them to be useful to limit microbial growth in pavement markings include, but are not limited to, benzimidazoles such as those commercially available under the trade name Metasol TK-100™ (Calgon Corp., Pittsburgh, Pa.); Dihaloalkyl arylsulfones including those commercially available under the trade name Amical™ (Angus Chemical Company, Buffalo Grove, Ill.) including Amical™ 48, Amical™ Flowable, Amical™ WP and Amical™ 50; pyrithiones such as those commercially available under the trade name Zinc Omadine™ (Olin Corporation, Stamford, Conn. available in both powder and liquid forms; isothiazolins including Skane M8 (Rohm & Haas, Philadelphia, Pa.); Nopcocide (Henkel Corp., Kankakee, Ill.); and NuoCide™ (Hills, Somerset, N.J.). Those skilled in the art will recognize that there are a variety of other antimicrobial agents with properties and characteristics, recognized by those in the art in view of this disclosure, that are also suitable for use in preformed pavement markings.

Levels of the antimicrobial agents in the pavement markings of this invention will vary depending on the antimicrobial agent. The American National Standards Institute test ANSI A136.1-1967 is a useful procedure for testing mold inhibition to determine useful concentration ranges of antimicrobial agents in pavement marking materials. Other useful testing procedures to determine the effective concentration range of a particular antimicrobial agent to inhibit the growth of bacteria and/or fungus include ASTM G21-90 and ASTM G22-76 ("Standard Practice for Determining Resistance of Synthetic Polymeric Materials to Fungi" and "Standard Practice for Determining Resistance of Plastics to Bacteria" respectively, available in ASTM *Standards on Materials and Environmental. Microbiology*, 1993, American Society for Testing Materials, Philadelphia, Pa.).

Initial useful testing ranges for incorporating an antimicrobial agent into a primer or adhesive include, for example, Zinc Omadine™ powder at preferred initial ranges of about 0.05% to about 0.4% by liquid weight of the primer or adhesive. Zinc Omadine™ liquid is preferably initially tested in the range of about 0.05% to about 0.8% by liquid weight. Amical™ 48 is used at about 0.05% to about 1.0% by weight and Metasol™ TK-100 at about 0.05% to about 0.3% by liquid weight.

A pavement marking system is provided that includes pavement marking with antimicrobial agent supplied in a marking alone, with an adhesive, either as a separate component or preapplied to the marking where the adhesive is provided with or without antimicrobial agent. A primer is also optionally supplied with the system and the primer can be supplied with or without an antimicrobial agent. At least one component of the system includes an antimicrobial agent.

One or more different antimicrobial agents can also be incorporated into the pavement markings. For example, one or more agents, such as a combination of antimicrobial agents selected from the exemplary antimicrobial agent group provided above or alternatively other antimicrobial agents, having characteristics suitable for use in preformed pavement markings (as provided in the above discussion) can be added to the primer, to the adhesive, or incorporated into the marking. The antimicrobial agent can be incorporated during manufacture of the primer or adhesive or added to prepared primer or adhesive compositions. The antimicrobial agent can be added to a layer of the pavement marking by spray or incorporated into a composition making up one or more layers of the pavement marking.

Preformed pavement markings are applied to a variety of pavement surface types including standard mix asphalt, open grade friction course, chip seal, slurry seal, recycled asphalt, rubberized asphalt, portland cement concrete, and the like. Preformed pavement markings are added to pavement surfaces at the time of paving or on an existing paved surface. Instructions for applying preformed pavement markings are supplied by the manufacturer of the preformed pavement markings. Where preformed pavement markings are applied to existing paved surfaces, the surface is first cleaned, usually with high-pressure air. Typically the pavement marking are applied to dry pavement surfaces (generally no rainfall about 24 hours prior to application of the pavement marking) and generally, one or more coats of a primer are applied to the pavement surface by casting, spraying or brushing the area intended for the marking. The primer is allowed to dry prior to application of the pavement marking. It is not always necessary that one or more coats of primer be applied to a pavement surface and certain pavement markings have recommended use instructions that include, for example, the use of one or more coats of an adhesive, without the use of a primer.

There are a variety of substances that can be used as primers for pavement marking and manufacturers may recommend preferred primers with particular pavement markings. Primers that are useful for pavement marking applications include, for example, Stamark™ E-44, Stamark™ E-44T and P-46, Stamark™ SP-44 sprayable adhesive, Scotch-Lane™ Pavement Preparation Adhesive P-40 (available from Minnesota, Mining and Manufacturing, St. Paul, Minn.), #BL 33 and #BL 52 (BRITE-LINE™, Bedford, Mass.), ATM primer and ATM contact cement (Advanced Traffic Markings, Roanoke Rapids, N.C.) and the primer compositions of U.S. Pat. No. 5,468,795 and U.S. Pat. No 4,906,523.

Antimicrobial agents were added to primer compositions to test their ability to inhibit microbial growth. The results of Example 3 demonstrated that the addition of antimicrobial agents to primers suppressed microbial growth and maintained the integrity of the primer composition.

Adhesives used in pavement markings are generally applied to the pavement-contacting portion of the marking before the marking is positioned on the pavement. There are a variety of adhesives that are used to adhere pavement markings to pavement surfaces and these include, but are not limited to, tackified polybutadiene adhesives, such as those disclosed in U.S. Pat. No. 3,451,537 to Freeman et al., prepared by solvent containing processes, butyl rubber adhesives, polybutadiene adhesives prepared by solventless processes such as those of U.S. Pat. No. 5,453,320 to Harper et al., natural rubber adhesives, and silicone based adhesives, such as those of U.S. Pat. No. 5,310,278 to Kaczmarczik et al.

One or more antimicrobial agents can be added to the primer at the site and time of manufacture, or the antimicrobial agent can be added to the primer composition at the time of pavement marking system installation. One or more antimicrobial agents can also be added to the adhesive and/or to the pavement marking, generally at the site of pavement marking manufacture, or the adhesive can be supplied to the pavement marking manufacturer with or without antimicrobial agent at a concentration sufficient to inhibit microbial growth on a pavement. Concentrations of antimicrobial agent can be tested using the methods of Examples 3 and 4. One or more antimicrobial agents can also be sprayed onto the adhesive affixed to the pavement contacting surface of the preformed marking or to the traffic-controlling, exposed surface of the pavement marking prior to or after pavement system installation. The term "pavement contacting surface" refers to the orientation of the pavement marking on the pavement. Layers of adhesive and/or primer can be interposed between the pavement and the pavement contacting surface.

There are a variety of pavement markings that are commercially available and one or more antimicrobial agents can be added to the pavement markings as a coating or one or more antimicrobial agents can be integrated into a component of the preformed pavement marking. Examples of pavement marking tapes include, but are not limited to Stamark Tapes™, Scotch-Lane™ Tapes (Minnesota Mining and Manufacturing), Series 100, 200, 1000 and Vibraline™ pavement marking tapes (BRITE-LINE™ Inc.). Director, Director 2, the foil marking tapes of Swarco Inc. (Columbia, Tenn.) and the ATM Series 200, 300, and 400 pavement marking tapes of Advanced Traffic Marking, Inc. Other preformed pavement markings include those of EP91 309 941, disclosing a pavement marking material with a top layer, an optional base sheet and a layer of adhesive where the adhesive comprises a rubber and a high-loading of tackifier; and U.S. Pat. No. 3,902,939 to Eigenmann, disclosing a pavement marking material that utilizes an adhesive that is not tacky at room temperature but which is activated by a hot primer layer or solvent to provide adhesion to pavement surfaces. Other preformed pavement markings include U.S. Pat. Nos. 5,227,221 to Hedblom, 4,681,401 to Wyckoff, 4,388,359, and 3,935,365 to Eigenmann. Preferably the antimicrobial agent does not detrimentally stain or substantially discolor the pavement marking portion of the pavement marking system.

Pavement markings are prepared from one or more layers generally including an upper, sign forming or traffic wear-resisting layer and a base layer. Conformance layers are also included in some pavement markings. Where there is more than one layer in the pavement marking, one or more antimicrobial agents can be applied to any of the layers. One or more layers of bonding material can be interspersed between the layers to provide an intact, multi-layered marking. Particles or microspheres are optionally positioned on the upper layer these particles and/or microspheres are generally attached to the upper layer embossing, adhering or affixing the particles and/or microspheres to the upper layer.

The various layers of the marking can include one or more layers of adhesive, bonding agent or the like containing one or more antimicrobial agents. For example U.S. Pat. Nos. 5,194,113, 5,077,117, or 5,227,221 disclose multi-layered pavement markings with skid preventative particles placed thereon and/or reflective particles embedded therein. In general, the embedding material and/or binding materials used to incorporate the particles can include one or more antimicrobial agents; urethane, vinyl or ethylene methacrylic acid top coats can incorporate antimicrobial agents; the adhesive layers within the marking can include antimicrobial agents; one or more antimicrobial agents can be interspersed into the polymer material or the conformance layer during manufacture; and/or a composition comprising an antimicrobial agent can be sprayed onto one or more surfaces of the pavement marking prior to use or once the pavement marking is in place on the pavement.

Preferably concentrations of an antimicrobial agent are tested for their ability to inhibit microbial growth when the antimicrobial agent is combined with one or more components of the pavement marking. Pavement marking systems with antimicrobial agents interspersed in the marking, the adhesive or the primer components of the pavement marking system can be tested on a pavement for their ability to resist microbial degradation and their ability to remain affixed to a pavement. Example 4 details one study designed to look at the effect of antimicrobial agents in pavement marking systems positioned in areas of low, medium and high traffic stress.

This invention also contemplates the addition of one or more antimicrobial agents in a liquid as a coating to be applied to a pavement surface prior to the installation of the pavement marking system. The addition of one or more antimicrobial agents, preferably following a cleansing or surface preparation step to remove debris, particularly for preexisting pavement surfaces, will also improve the longevity of the pavement marking on the a pavement surface. Disinfection steps can include a variety of washes, in water with or without a detergent, solvent applications, heat treatments or pressurized air treatments and also include brushing and sweeping to remove debris on the pavement surface. Alternatively, one or more antimicrobial agents can be applied to the installed pavement directly following installation or as a maintenance therapy to increase the longevity of the pavement marking system on the pavement. Antimicrobial agents can be applied to the pavement using appropriate media and/or solvents compatible with antimicrobial activity and known to those of ordinary skill in the art.

All references and publications cited herein are expressly incorporated by reference into this disclosure. Particular embodiments of this invention will be discussed in detail and reference has been made to possible variations within the scope of this invention. There are a variety of alternative techniques and procedures available to those of skill in the art which would similarly permit one to successfully practice the intended invention.

EXAMPLE 1

Microorganism Growth Alters Physical Properties of Primers

Primer Stamark™ E-44 was coated onto silicone release liner and dried to a dry film thickness of approximately 5 mils (0.005 in. or about 0.0127 cm). The dried E-44 primer film was removed from the silicone coated paper liner and was cut into 13 strips measuring about 1"×8". Five of the strips were soaked in water for three weeks and served as the control samples. Five strips were placed on a petri plate containing nutrient agar (Difco, Detroit, Mich.) and subjected to attack by various bacterial and fungal species present in activated sludge. The microbial species were chosen to reflect the range of species observed in samples taken from pavement markings that showed evidence of deterioration. These agents include Myxomycetes including the genera Physarum; Zygomycetes, including the genera Mucor; and other fungi including, but not limited to Aspergillus, Penicillium, Fusarium and the like. Exemplary bacterial species include members of the genera Staphylococcus, Streptococcus, Bacillus, Pseudomonas, Actinomyces, and others. Samples were subjected to attack at 35° C. for a period of three weeks. The remaining samples were stored at room temperature (about 20°–25° C.). After incubation, the samples subjected to microbial attack were subjected to manual stress. Samples appeared to pull apart easily while the samples were still moist from the incubation conditions.

The tensile strength of the samples were compared by testing a 1 inch (2.54 cm) gage length sample that was representative of each strip. The samples were tested using a standard tensile testing apparatus that pulled samples at a rate of about 10"/min. All of the samples were tested dry after equilibrating at room temperature.

One-way Analysis of Variance (ANOVA) showed significant changes in stress at yield, stress at break and peak stress for the samples exposed to microbial attack. Stress at yield is calculated by dividing the load at the yield point by the original minimum cross-section area of the sample. The yield point is the first point on the stress-strain curve at which an increase in strain occurs without an increase in stress. Stress at break refers to the tensile load per unit area of a minimum original cross-section, within the gage boundaries, carried by the test specimen at any given moment. Break is the moment of rupture of the test specimen. Peak stress refers to the maximum tensile stress sustained by the specimen during a tension test. Strain at yield relates to the percent elongation at the moment the yield point is attained in the test specimen. Percent elongation is the increase in length produced in the gage length of the test specimen by a tensile load expressed as a percentage of the gage length. The gage length is the original length of that portion of the specimen over which strain or change in length is determined.

Slight changes in the properties of the water soaked samples were observed, although the ANOVA analysis indicated low probability that the water soaked samples were statistically different from the controls given that there was significant overlap between the two populations for the samples measured.

The following results were based on the mean values of five samples tested for the water soaked group, five samples exposed to microbe and 3 control samples for each of the following properties:

1. Stress at yield decreased by about 53% for samples exposed to microbes (712.6 psi) compared to the controls (1504 psi), while water soaked samples experienced about a 14% decrease (1292.2 psi).
2. Stress at break decreased by about 41% for sample exposed to microbes (978.8 psi) compared to the controls (1689 psi), while water soaked samples experienced about a 13% decease (1465.8 psi).
3. Peak stress decreased by about 42% for samples exposed to microbes (977.4 psi) compared to the controls (1689 psi), while water soaked samples experienced about a 13% decrease (1465.8 psi).
4. ANOVA results for % strain at yield indicated some overlap between the three sample populations. The mean values of the % strain at yield ranged from about 5.3% for the control to about 6.5% for water soaked samples to about 9.3% for the samples exposed to microbes. These results indicated that this parameter did not necessarily reflect the changes that were observed in the samples.

EXAMPLE 2

Microorganism Growth Alters Physical Properties of Pavement Marking

In the field, microorganisms (including bacterial colonies, fungus and algae) were identified in all layers of the pavement marking based on visual inspection and microscopic analysis. In one example, alterations in all layers of the pavement marking were observed in pavement markings made according to U.S. Pat. No. 5,077,117. The pavement marking appeared to take on a swelled, sponge-like texture and top portions of the pavement marking could be pulled away from the pavement surface in a "gum-like" fashion. Samples of the pavement marking having these characteristics were placed on petri plates containing nutrient agar (Difco) and the characteristics observed in the field were exacerbated with further incubation under conditions known to support microorganism growth.

EXAMPLE 3

Inhibition of Microbial Growth in Primer Compositions

The procedures used followed those of ASTM G21-90 (Practice for Determining Resistance of Synthetic Polymeric Materials to Fungi) and G22-76 (Practice for Determining Resistance of Plastics to Bacteria)

Activated sludge was obtained from a waste water treatment plant. 500 mL was split between two 250 mL sterile conical centrifuge tubes. The samples were centrifuged (3,000×g) for 10 minutes. The supernatant was discarded and the pellet was resuspended in 200 mL of carbon-filtered well water. The samples were centrifuged again and the supernatant discarded. The pellet was resuspended in sterile nutrient salts solution (about 200 mL). This step was repeated one additional time. Samples were resuspended and quantitated and the sample was diluted to an approximate volume of $1\times10^6$ colony forming units (cfu)/ml in sterile nutrient salt solution (same as nutrient agar, without agar).

Stamark™ E-44 and E-44T primers (available from Minnesota Mining and Manufacturing) were mixed separately with an antimicrobial agent (Zinc Omadine™ (powder) at 1000 ppm and 2000 ppm; Zinc Omadine™ (48% Dispersion and 48% fine particle size) at 1000 ppm and 2000 ppm; Metasol™ TK-100 at 1500 ppm; or Amical™ 48 at 3000 ppm) in liquid primer and coated onto sterile 5 cm glass fiber paper (Gelman Sciences, Ann Arbor, Mich.). The discs were allowed to dry for 48 h at room temperature and were then placed onto nutrient salts agar as provided in ASTM G21-90 and G22-76 (citations provided supra).

Nutrient salts agar can be prepared by dissolving in 1 L of Millipore Milli-Q™ water 0.7 g $KH_4$, 0.7 g $K_2HPO_4$, 0.7 g $MgSO_4$, $7H_2O$, 1.0 g $NH_4NO_3$, 0.005 g NaCl, 0002 g $FeSO_4.7H_2O$, 0.002 g $ZnSO_4.7H_2O$, 0001 g $MnSO_4H_2O$ and 15.0 g Agar (all available from Sigma, St. Louis, Mo.) with pH in range of 6.0–6.5 and sterilized by autoclaving at 121° C. for 20 min.

The activated sludge was sprayed onto the plates using a sterilized atomizer until the entire surface was moistened with the suspension. The plates were incubated at 35° C. with a relative humidity of not less than 85%. Controls were standardized based on observation of extensive growth on control specimens within 14 days of incubation to qualify as a valid test.

One time per week for four weeks growth was recorded based on microorganism growth to no growth scale using a visual comparison scale of 0–4, 10% growth was rated as 1, 10–30% growth was rated as 2, 30–60% growth was rated as 3 and 60% or greater coverage was rated as 4. Controls included untreated discs and discs treated with primer without antimicrobial agent.

Control primers to not exhibit and antimicrobial effect. The samples treated with Zinc Omadine power appeared to have substantial microorganism inhibitory activity under the conditions tested.

EXAMPLE 4

Strategy for Testing Antimicrobial Agents in Primer and Adhesive Compositions on a Pavement Preformed pavement markings such as that disclosed in U.S. Pat. No. 5,453,320, U.S. Pat. No. 5,227,221 and in a preferred embodiment, U.S. Pat. No. 5,077,117, are cut to a size ranging between 2 ft×8 ft, samples of 1 ft×8 ft or samples 1 ft×4 ft. Size of the samples will depend on traffic intersection size and the number of variables that will be included at a test site. Samples are applied to test pavement located in a wet, humid climate; for example, the U.S. pacific northwest, such as Oregon or Washington, or other worldwide locations with climates similar to the pacific northwest; in the U.S. southeast, such as Florida, Louisiana, or Alabama; areas along the eastern U.S. seaboard; and areas of Central Europe or coastal regions of Europe receiving year round rainfall and having high relative humidity.

The samples are applied using either one palmer coat with adhesive or three primer coats without adhesive using test antimicrobial agents, such as, but not limited to, Zinc Omadine™, Metasol™ TK-100 or Amical™ 48 and including control samples without antimicrobial agents. The test samples are positioned on various locations on a pavement receiving a variety of traffic stresses such as documented areas receiving low, medium or high traffic stress from vehicle use. Similar studies can be used to assess the effect of one or more antimicrobial agents in the adhesive or one or more antimicrobial agents added in the pavement marking. Low traffic stress is generally areas of a pavement that receive little wheel track contact and preferably includes stress levels of less than 3500 Average Daily Traffic (ADT) /lane. ADT refers to the number of vehicle impacts per day. High traffic stress generally includes turn lanes ranging from values greater than 5500 ADT/lane and medium stress includes levels of about 3500 to about 5500 ADT/lane.

Other pavement test parameters are peel test measurements. In these experiments, the applied pavement marking is pulled from the pavement at a 90° angle and the force requirement to lift the pavement marking is compared where one or more antimicrobial agents have been added to one or more components of the pavement marking system. Other tests include the visual and microscopic analysis of different components of the pavement marking system after the pavement marking has been applied to a pavement. Culture analysis can also be performed to assess the extent and type of microorganism growth in the pavement marking system.

It will be appreciated by those skilled in the art that while the invention has been described above in connection with particular embodiments and examples, the invention is not necessarily so limited and that numerous other embodiments, examples, uses, modifications and departures from the embodiments, examples and uses may be made without departing from the inventive scope of this application.

What is claimed is:

1. A pavement marking system comprising:

a preformed pavement marking comprising at least one layer, the marking having a pavement contacting surface; and an adhesive composition comprising an antimicrobial agent applied to the pavement contacting surface of the pavement marking.

2. The pavement marking system of claim 1 wherein the pavement marking includes an antimicrobial agent in at least one layer of the marking.

3. The pavement marking system of claim 1 additionally comprising a primer.

4. The pavement marking system of claim 3 wherein the primer comprises an antimicrobial agent.

5. The pavement marking system of claim 1 wherein the antimicrobial agent has a solubility in water of less than 0.002 g/L at 25° C.

6. The pavement marking system of claim 1 wherein the antimicrobial agent is capable of inhibiting more than one species of microorganism at concentrations of antimicrobial agent of less than about 1000 ppm on nutrient salts agar.

7. The pavement marking system of claim 6 wherein the antimicrobial agent is capable of inhibiting more than one species of fungus.

8. The pavement marking system of claim 6 wherein the antimicrobial agent is capable of inhibiting more than one species of bacteria.

9. The pavement marking system of claim 4 wherein the antimicrobial agent in the primer has a solubility in water of less than 0.002 g/L at 25° C.

10. The pavement marking system of claim 4 wherein the antimicrobial agent in the primer is capable of inhibiting more than one species of fungi and more than one species of bacteria at concentrations of antimicrobial agent of less than about 1000 ppm.

11. A pavement marking system comprising:

a preformed pavement marking comprising at least one layer, the marking having a pavement contacting surface;

an adhesive applied to the pavement contacting surface of the preformed pavement marking;

a liquid primer; and at least one antimicrobial agent contained within the system such that the antimicrobial agent is present in the pavement marking system when the system is affixed to a pavement.

12. The system of claim 11 wherein the antimicrobial agent is contained within at least one layer of the preformed pavement marking.

13. The system of claim 11 wherein the antimicrobial agent is contained within the adhesive.

14. The system of claim 11 wherein the antimicrobial is contained within the primer.

15. The system of claim 11 wherein the antimicrobial agent has a solubility in water of less than 0.002 g/L at 25° C.

16. The system of claim 11 wherein the antimicrobial agent is capable of inhibiting more than one species of microorganism at a concentration of less than about 1000 ppm in nutrient salts.

17. The system of claim 16 wherein the microorganism is a species of fungi.

18. The system of claim 16 wherein the microorganism is a species of bacteria.

19. A preformed pavement marking comprising one or more layers wherein one or more layers of the marking comprise at least one antimicrobial agent wherein the antimicrobial agent is capable of inhibiting more than one species of microorganism at a concentration of less than about 1000 ppm in nutrient salts agar.

20. A pavement marking system comprising:

a preformed pavement marking comprising one or more layers;

an adhesive comprising an antimicrobial agent; and a primer comprising an antimicrobial agent.

21. The system of claim 20 wherein the preformed pavement marking comprises at least one antimicrobial agent.

22. A method for applying a pavement marking system to a pavement comprising the steps of:

coating a pavement surface with a primer comprising at least one antimicrobial agent; and positioning and affixing a pavement marking, the pavement marking having a pavement contacting surface, onto the primer with the pavement contacting surface contacting the primer.

23. The method of claim 22 where the pavement marking of the positioning and affixing step comprises at least one layer wherein at least one of the layers includes an antimicrobial agent.

24. The method of claim 22 wherein the method additionally comprises the steps of applying an adhesive to the pavement contacting surface of the pavement marking and contacting the adhesive on the pavement contacting surface with the primer.

25. The method of claim 22 wherein the adhesive contains at least one antimicrobial agent.

26. The method of claim 22 additionally comprising the step of cleaning the pavement prior to the coating step.

27. The method of claim 26 wherein the cleaning step includes treating the pavement with at least one antimicrobial agent before the coating step.

28. The method of claim 22 additionally comprising the step of treating the pavement marking system with at least one antimicrobial agent after the positioning and affixing step.

29. The method of claim 24 additionally comprising the step of treating the pavement with at least one antimicrobial agent after the positioning and affixing step.

30. A method for making an adhesive coated pavement marking comprising the steps of:

adding an antimicrobial agent to an adhesive capable of adhering a preformed pavement marking to a pavement; and coating at least a pavement contacting surface of the preformed marking with the adhesive.

31. A method for maintaining the integrity of a preformed pavement marking system on a pavement comprising the steps of:

treating the preformed pavement marking system on the pavement at least once with an antimicrobial agent.

32. The method of claim 31 wherein the treating step is performed at least once a year.

33. A method for increasing the life-span of a preformed pavement marking system on a pavement comprising the steps of:

including at least one antimicrobial agent in the preformed pavement marking system where the antimicrobial agent in sterile nutrient salt media is sufficient to inhibit the growth of at least one species of microorganism on a nutrient agar petri plate when the antimicrobial agent has been preincubated for at least three weeks at about 35° C.

* * * * *